US006033270A

United States Patent [19]

Stuart

[11] Patent Number: 6,033,270

[45] Date of Patent: Mar. 7, 2000

[54] ELECTRICAL CONNECTOR DEVICE

[76] Inventor: Ross M. Stuart, 68320 Moonlight Dr., Cathedral City, Calif. 92234

[21] Appl. No.: 09/097,802

[22] Filed: Jun. 16, 1998

[51] Int. Cl.[7] ..... H01R 13/05

[52] U.S. Cl. ..... 439/825; 439/884

[58] Field of Search ..... 439/825, 884, 439/595, 877–879, 882; 29/881, 884

[56] References Cited

U.S. PATENT DOCUMENTS 4,955,827 9/1990 Roy et al. ..... 439/595

*Primary Examiner*—Michael L. Gellner
*Assistant Examiner*—Antoine Ngandjui
*Attorney, Agent, or Firm*—Edward E. Roberts

[57] ABSTRACT

An electrical connector assembly in which the pin connector assembly is formed of pin members having at least one spring protrusion adjacent the end thereof, the socket connector assembly being formed of a hollow tubular configuration arranged in an array within an insulating body and configured for matingly receiving the pin connector assembly, improved electrical conductor connection being effected by the protrusion urging against the inner surface of the socket to provide an improved line of electrical contact between the pin member and the socket member.

18 Claims, 2 Drawing Sheets

*Fig. 5*
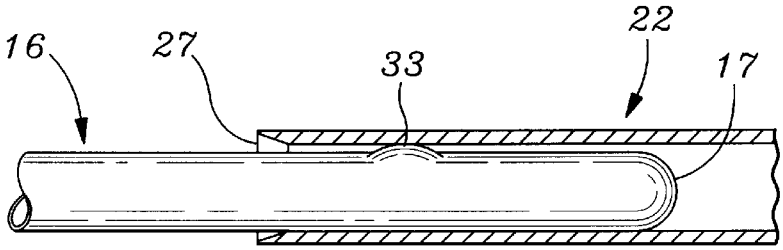
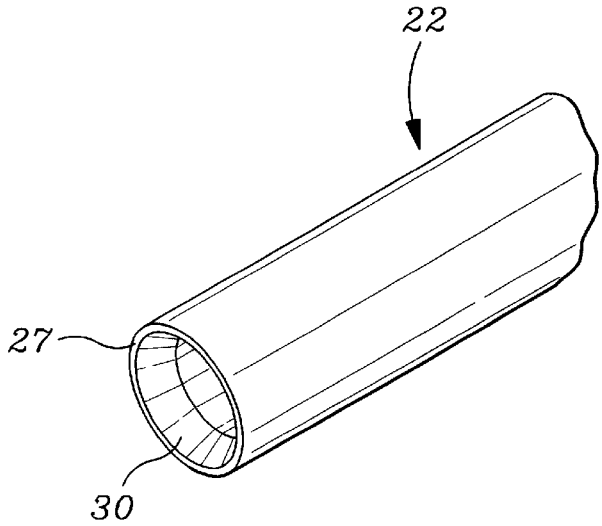
*Fig. 6*
*Fig. 7*
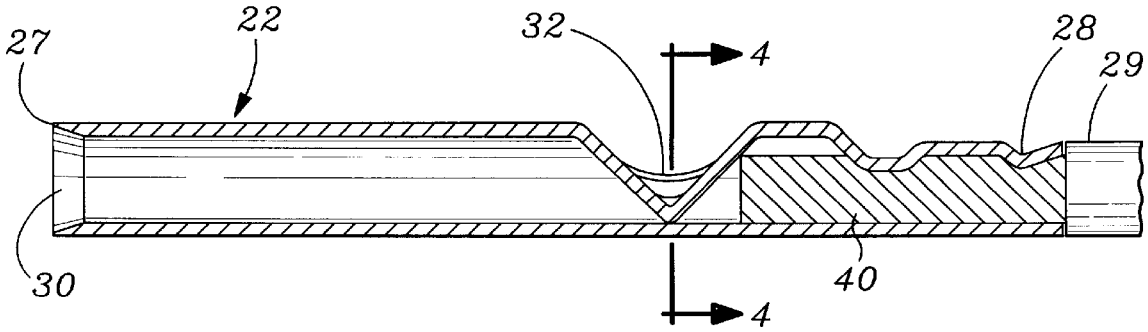

ELECTRICAL CONNECTOR DEVICE

BACKGROUND OF THE INVENTION

The background of the invention will be discussed in two parts.

1. Field of the Invention

This invention relates generally to electrical connector devices, and more particularly to an electrical connector device including a spring pin member having a protrusion thereon.

2. Description of the Prior Art

Electrical contact assemblies for electronic systems and devices have been utilized extensively. In many instances such contact assemblies are employed to facilitate initial fabrication and ultimately to facilitate service or replacement of sub-components on a modular basis. One of the more commonly employed type of electrical contact assembly includes a plurality of contact elements, such as contact pins, in an array within an insulative body, for mating connection to a like number of arrayed aligned contact sockets configured for receiving the pins in sliding relation.

Such electrical contact assemblies include some means for providing friction for insertion and retention of the pin within the socket. Such friction is typically accomplished by configuration of the socket with longitudinally extending slots or kerfs. In other such devices, the socket may be provided with a circumferentially reduced diameter portion.

In any event, with miniaturization and micro-miniaturization of electronic components and subassemblies, demands have been placed on manufacturers of electrical contact assemblies for smaller and smaller devices. Wiring techniques have progressed to "ribbon" conductors in which a generally flat ribbon or sheath incorporates an aligned row of a plurality of stranded or braided, very small gauge, conductors, equally spaced across the width of the ribbon. To facilitate coupling, connectors have been developed for "matching up" to the conductor spacing.

Electrical contact assemblies have been reduced in size to where contact pins may have a dimension in the order of 0.0125 inches for insertion in a socket having an outer diameter of 0.018 inches with adjacent sockets spaced on 0.025-inch centers providing a density of about 1000 contacts per square inch. Such reductions in size are accompanied by corresponding problems.

One basic problem relates to the very small dimensions of both the contact pin and the socket, whereby the slightest transverse force can result in bending or even breakage. In addition, the contact assemblies must be capable of repeated insertions and withdrawals without significant distortion of the interconnecting parts which could result in lack of electrical integrity.

In providing electrical interconnection between fine gauge ribbon conductors and the connectors, soldering has been supplemented by mechanical means, such as crimping. For crimping or soldering purposes, a portion of the insulator surrounding the conductor is removed exposing a length of each conductor in the ribbon. The conductors are positioned within tubular portions of the contact pin or socket and mechanical force is applied to deform the tubular portion to provide a mechanical coupling of the conductor therein. Such crimping may take any convenient form, but typically results in the crimped cross-section being in the shape of a star or figure eight, that is, the crimping force is applied from diametrically opposite sides of the tubular portion along a line. The crimping or soldering must be accomplished in such a manner that the strands of the conductor are not broken and must enable the conductor to be retained therein despite a pull in the axial direction of a minimum predetermined force. A solder bleed hole must be provided in the contact member to enhance the soldering process.

In such connector assemblies, electrical contact in the separable sliding or telescoping members requires a minimum normal force between the members to establish a low electrical resistance gas-tight Junction. The normal force required varies with the metallic materials involved as well as the surface finish, roughness, plating and oxide films.

The most common contact system employed in electrical connector assemblies consists of a male contact or pin that telescopes into a female "spring" contact. The shape of the pin and socket may be round, square, triangular or rectangular in cross-section. Most such sockets are designed of simple end supported beams formed by strips or longitudinal slotting, all of which are fabricated to provide one or more longitudinal arms that flex or deflect transversely, to provide the normal force to effect the electrical contact, when mated with the male member.

As a consequence of this geometry, the spring socket contact is lengthened. Furthermore, to test electrical circuits it is necessary to insert a probe into the spring socket and care must be exercised to ensure that the spring elements are not deflected beyond their elastic limits. To avoid such danger the common practice is to house the spring socket in a close fitting support sleeve or shroud as an integral part of the socket, or ensure that the cavity surrounding the contact provides the support to prevent this probe damage. Partially for this reason it is customary to house the socket within the insulator, and employ exposed cantilevered contact pins for the mating connector. With this geometry the more fragile member of the contact system is exposed and more easily damaged or bent.

An example of a flexible pin electrical contact is described in U.S. Pat. No. 4,660,922, entitled "Terminal Plug Body and Connector", which issued to Cooney on Apr. 28, 1987.

An example of a connector assembly is shown and described in U.S. Pat. No. 5,254,022, issued to Stuart on Oct. 19, 1993, for "Electrical Connector Device and Method of Manufacture Thereof", in which the socket is formed of seamless tubular members having a spring depression adjacent the open end thereof.

Another example of a spring socket contact is shown and described in U.S. Pat. No. 5,385,492, entitled "Electrical Connector Device and Method of Manufacture Thereof", which issued to Stuart on Jan. 31, 1995.

In accordance with an aspect of the invention, it is an object of the invention to provide a new and improved electrical connector assembly and method for the manufacture thereof.

SUMMARY OF THE INVENTION

The foregoing and other objects of the invention are accomplished by providing an electrical connector assembly in which the pin connector assembly is formed of tubular members having one or more spring protrusions adjacent the end thereof, the socket connector assembly being formed of a hollow tubular configuration arranged in an array within an insulating sleeve or body and having socket members formed as a cantilevered array protruding from the insulative body. Improved electrical conductor connection is effected by the protrusion urging against the inner surface of the socket to provide a continuous line of electrical contact between the pin and the socket.

Other objects, features and advantages of the invention will become apparent from a reading of the specification when taken in connection with the drawings, in which like reference numerals refer to like elements in the several views.

BRIEF DESCRIPTION OF THE DRAWINGS

FIG. 5 is a view showing engagement of the protrusion of the spring pin of the invention within a cross-sectional view of a portion of the socket member of FIG. 1;

FIG. 6 is an enlarged perspective view of the socket-engaging end of the socket member of FIG. 1; and FIG. 7 is a cross-sectional view of showing details of the socket member of FIG. 1.

DESCRIPTION OF THE PREFERRED EMBODIMENTS

Figure 1:
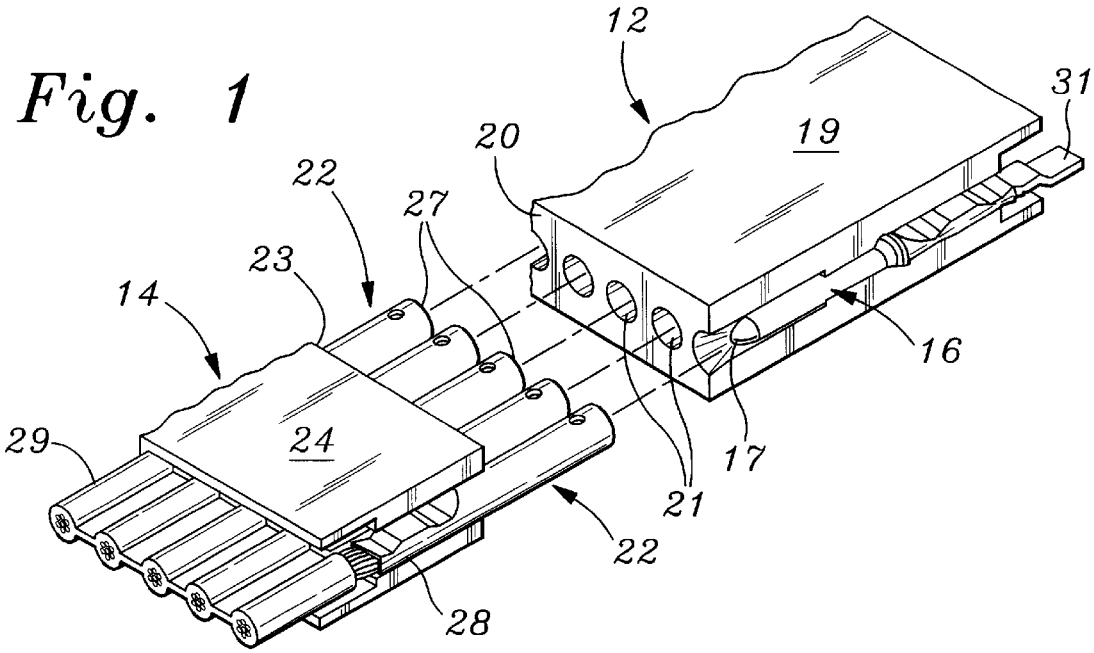
FIG. 1 is a perspective view, partially broken away, of an electrical connector assembly according to the invention.
Figure 2:
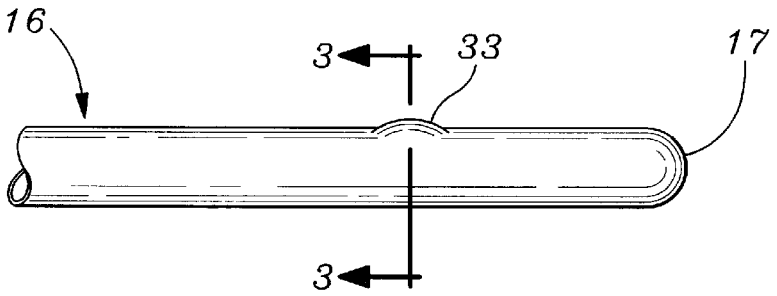
FIG. 2 is a view illustrating the pin member of the connector assembly of FIG. 1 showing the spring pin protrusion of the invention.

Referring now to the drawings, there is shown an electrical connector assembly including a pin connector assembly generally designated 12, and a socket connector assembly generally designated 14. Pin connector assembly 12 includes an array of pins generally designated 16, that is, a plurality of row aligned generally parallel, equally spaced contact pins (only one of which is shown), each being generally identical, with the contact pins 16 being formed as hollow members.

The socket connector assembly 14 is shown configured of a mating array, that is, a like plurality of row aligned tubular socket members, generally designated 22, each of which is generally identical and formed into tubular electrically conductive material. To meet the demanding requirements of today's electronic devices, both the pin 16 and the socket member 22 are normally formed of gold plated conductive metallic material.

The plurality of contact pins 16 are maintained in a generally parallel equally spaced orientation and in row alignment (that is, the longitudinal axes thereof lie in a common plane) by the method of embedding or molding the pins 16 into a common cubically configured connector body 19 formed of a suitable insulation material. Formed within a generally planar face 20 of the body coaxial with the pins 16 are a like number of pockets or cylindrically configured recesses 21, each of which is configured, dimensioned and arranged to receive the pin 16 in coaxial relation therein with the end 17 inwardly spaced from the open end of the recess 21.

The socket members 22 are maintained in aligned row oriented relation (that is, the longitudinal axes thereof lie in a common plane), by means such as embedment or molding within a body 24 of suitable insulating material. The socket members 22 are shown cantilevered with the free ends 27 projecting out from the end face 23 of the body 14 a distance sufficient for enabling insertion of the tubular socket members 22 into the matingly formed recesses 21 of the body 19 for electrically conductive engagement with spring pins 16. For this purpose, the outer diameter of the pins 16 in the area of the protrusion 33 is slightly larger than the inner diameter of the tubular socket member 22.

The end face 23 of the socket connector assembly 14 is configured and dimensioned generally identically to the end face 20 of the pin connector assembly 12. With the pins 16 engaging socket members 22, the faces 23 and 20 are in planar abutting relation. The opposite ends 28 of the socket members 22 are configured for receipt of electrically conductive means, such as cable 29.

Although a connector assembly is shown and discussed, it is to be understood that the concept of protrusion spring pin 16 is applicable in other electrical connector configurations.

The end 17 of pin 16 is rounded and configured for insertion into a corresponding electrical socket member 22. The opposite end 31 of pin 16 is configured for suitable attachment to a conductive member such as an electrically conductive cable or ribbon member 40 (FIG. 6).

For a given length, the outer diameter of the outward bulge, or protrusion 33 is such that it is greater than the inner diameter of the socket 22, with the outer diameter of the protrusion 33 being sufficient for engagement with the socket 22, as will be described. In this manner, the pins 16 are protected by a shroud or housing, wherein the insulating material of the body 12 provides protection against bending or breakage.

As shown in various detail in the figures, pin members 16 are configured to provide a spring action relative to the sockets 22, to provide means for facilitating engagement of the sockets 22, and to provide means for receipt of the cable 29 or other electrical conductor such as ribbon conductor means.

For spring action during insertion of pin 16 into socket member 22, a generally oval-shaped protrusion 33 of a controlled size is provided by forming the protrusion in the outer surface of pin 16 adjacent the pin mating end 17. One or two such areas 33 may be provided with the long axis of protrusion 33 aligned with the longitudinal axis of pin 16. To provide optimum spring action, protrusion 33 is formed at a predetermined distance from the end 17, this distance being correlated to the diameter of the tubing employed. If the protrusions were to be located too close to the end 17, insertion of the pin 16 therein would be more difficult. In the preferred embodiment, the distance between the center of the protrusion 33 and the end 17 is approximately three times one outer diameter of the tubing, but generally no more than five diameters in distance.

Figure 3:
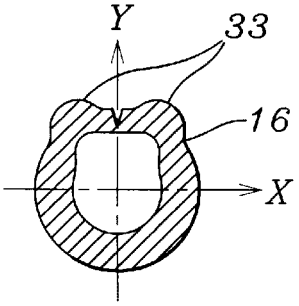
FIG. 3 is a cross-sectional view of the pin member of FIG. 2 as viewed along line 3—3 thereof showing details of the embodiment having two spring pin protrusions.

During the formation of the protrusion 33 the pin member 16 becomes slightly elliptical at the zone of formation, that is, the distance in the "Y" direction is slightly greater than the distance in the "X" direction (FIG. 3). The combination of the protrusion 33 and the slightly elliptical shape of the pin member 16 at the zone of formation provides a spring engaging force when the pin is inserted into socket member 22. It is to be understood that while two protrusions are shown in FIG. 3, in certain applications one protrusion is sufficient and thus more desirable. The height of the protrusion 33 is selected to produce the desired engaging force for holding the pin 16 in place, that is, a minimum amount of frictional engagement must be accomplished.

Protrusion 33 is formed, configured, dimensioned and arranged to minimize localized stress concentration while providing the required spring engagement force. It is not a sharp indentation, but a smoothly flowing protrusion in an axially seamed or seamless tubular surface positioned at a point to provide a spring force after the pin 16 has been inserted an adequate distance into socket member 22.

For providing means for facilitating engagement of the pin 16 with sockets 22 (see FIGS. 5 and 6), the tapered inner opening 30 of socket 22 initially serves to facilitate entry of the pin 16. As pin 16 continues into further engagement within socket 22, the upper edge of the pin 16 meets with a spring force or friction at the outer surface of protrusion 33.

At this point the inner surface of the socket 22 urges against protrusion 33 attempting to restore the outer diameter of pin member 16 from a slightly elliptical configuration to a round configuration, to force the protrusion 33 inwardly (as viewed in the drawing). The lower lineal edge of pin 16 is thus forced against the lower (as viewed in the drawing) inner surface of socket 22 to effect an enlarged contact area providing a continuous electrical contact between the pin 16 and the inner surface of the socket member 22. Thus, a significant portion of the area of pin 16 is in excellent mechanical and electrically conductive contact with the arcuate inner lower surface of socket member 22 along a line diametrically opposite the highest outer point, or geometric center, of the protrusion 33.

As shown in FIGS. 6 and 7, the open end 27 of socket 22 is provided with a chamfered or tapered inner opening 30 to facilitate entry of the rounded end 17 of pin 16. There is an appropriately configured opening opposite the mating ends of both pin 16 and socket 22 to facilitate entry of electrical conductor 40.

Although spring pin 16 may be formed in various ways, one procedure is to start with an appropriate flat piece of material, generally copper alloy, place a dimple or depression into the surface thereof such that a protrusion is produced on the other side, and then roll the flat piece into the desired configuration such that the protrusion faces outwardly of the rolled material. The insertion end is then closed, or partially closed, in a substantially rounded configuration in any conventional manner.

Figure 4:
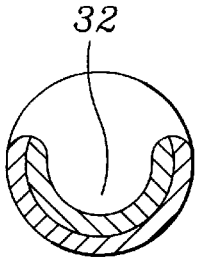
FIG. 4 is a cross-sectional view of the socket member as viewed along line 4—4 of FIG. 7 showing details of the connector wire stop portion.

A wire stop for socket conductor 22 is formed by a V-shaped depression 32 (FIG. 4), formed an appropriate distance from the end 28, sufficient to effect closure of the inner diameter of the member 22 to provide a wire stop.

There is provided an electrical connector assembly in which a socket member assembly, with the larger diameter connector elements configured for insertion into the recesses of a connector pin assembly, for coupling of spring pins having a protrusion thereon within the socket members in electrically conductive mating relation under force of the spring means provided by the protrusion 33 formed in the pin members 16.

While there has been shown and described a preferred embodiment, it is to be understood that various other adaptations and modifications may be made within the spirit and scope of the invention.

What is claimed is:

1. An electrical connector assembly comprising:

a) a pin connector assembly including i) insulating body means having an array of recesses formed in a face thereof;

ii) a spring pin member in each of said recesses, each of said pin members being generally identical and formed of electrically conductive material, with the insertion end of each of said pin members terminating at or inwardly of said face and having at least one protrusion formed integrally in the outer surface of said pin member a predetermined distance from the end thereof, said predetermined distance being correlated to the diameter of said pin member;

b) a socket receptacle connector assembly including i) insulating body means ii) an array of generally tubular socket members configured, dimensioned and arranged for mating coaction with said spring pin members within said socket members;

iii) each of said socket members after insertion of said spring pin member urging against said protrusion to provide abutting electrical engagement with the opposite inner side-wall of said socket member.

2. The electrical connector assembly according to claim 1 wherein said tubular socket members are circular in cross section and said pin members are of seamless tubular material and have substantially rounded ends for engagement with said socket members, said socket members having chamfered ends for facilitating such engagement.

3. The electrical connector assembly according to claim 1 wherein said at least one protrusion is generally oval-shaped with the long axis of the oval in axial alignment with the longitudinal axis of said pin member.

4. The electrical connector assembly according to claim 3 wherein said insulating body means of said socket connector assembly includes a face portion for abutting coaction with said face of said pin connector assembly.

5. The electrical connector according to claim 1 wherein the distance between the center of said protrusion and the insertion end of said pin member is in a range of from one to five diameters of said pin member.

6. The electrical connector assembly according to claim 2 wherein said distance from the end of said pin member is sufficient to enable partial insertion of the pin member within the socket member prior to engagement with said protrusion.

7. The electrical connector assembly according to claim 5 further including electrical conductor means and means for securing said conductor means to said pin and socket members of said connector assembly.

8. The socket members according to claim 7 further including generally V-shaped stop means having a depression angle of approximately 60 degrees formed in each of said socket members for enabling positioning of said conductor within the socket member a fixed distance.

9. An electrical connector assembly comprising:

a pin connector assembly including an insulating body having an array of recesses formed in a face thereof with an electrically conductive pin member in each of said recesses;

an insulating body having an array of generally circular in cross section tubular socket members configured, dimensioned and arranged for mating coaction with said pin members within said socket members;

each of said pin members is formed of tubular material and includes spring means for urging the pin member into abutting engagement with the opposite inner side-wall of said socket means; and said spring means including at least one protrusion integrally formed on the outer surface of said pin member a selected distance from the insertion end of said pin member to enable partial insertion of the pin member within said socket member prior to engagement of said protrusion.

10. The electrical connector assembly according to claim 9 wherein the abutting engagement of said protrusion with the opposite inner side-wall of said socket member results in an enlarged contact area providing for consistent contact engagement with respect to repeated contact mating.

11. The electrical connector assembly according to claim 9 wherein said selected distance is correlated to the outside diameter of said pin member.

12. The electrical connector assembly according to claim 11 wherein said protrusion is smoothly flowing from the outer surface of said pin member with said selected distance within a range of two to five times the outside diameter of said pin member and is substantially oval shaped with the long axis of the oval in axial alignment with the longitudinal axis of said pin member.

13. A method for forming a mechanical and electrically conductive contact in an electrical connector comprising:

providing a generally circular pin member having at least one protrusion thereon integrally formed a selected distance from the insertion end of said pin member, said selected distance correlated to the diameter of said pin member, providing a generally circular socket member for receiving said pin member;

inserting said pin member into said socket member whereby said protrusion abuttingly engages the opposite inner side-wall of said socket member resulting in an enlarged contact area between said pin member and said socket member.

14. The method of claim 13 wherein said selected distance is sufficient to enable partial insertion of said pin member within said socket member prior to engagement of said protrusion with said socket member.

15. The method of claim 14 wherein said step of providing said protrusion a selected distance from the insertion end includes selecting a distance whereby the center of said protrusion is in a range of from approximately one to five diameters of said pin member from said insertion end.

16. The method of claim 15 wherein said steps of providing a pin member and a generally circular socket member includes forming said pin member with a generally rounded end and said socket member with a chamfered opening for facilitating engagement of said pin member and said socket member.

17. The method of claim 13 wherein said pin member is formed by selecting a generally flat piece of conductive material, placing a depression into the face thereof to thereby produce a protrusion on the other side of said material, and rolling and joining said flat material into a generally circular configuration with said protrusion facing outwardly on the outside diameter of said circular configuration.

18. The method of claim 17 wherein said step of providing said protrusion a selected distance from the insertion end includes selecting a distance wherebv the center of said protrusion is in a range of from approximately one to five diameters of said pin member from said insertion end, and wherein said pin member is formed with a generally rounded and substantially closed end.

* * * * *